US009328913B2

(12) United States Patent
Yotsumoto et al.

(10) Patent No.: US 9,328,913 B2
(45) Date of Patent: May 3, 2016

(54) ELECTRIC LIGHT BULB TYPE LIGHT SOURCE APPARATUS

(71) Applicant: SONY CORPORATION, Tokyo (JP)

(72) Inventors: Naoki Yotsumoto, Tokyo (JP); Kouji Miyata, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/363,168

(22) PCT Filed: Nov. 30, 2012

(86) PCT No.: PCT/JP2012/007695

§ 371 (c)(1),
(2) Date: Jun. 5, 2014

(87) PCT Pub. No.: WO2013/102969

PCT Pub. Date: Jul. 11, 2013

(65) Prior Publication Data

US 2015/0049461 A1 Feb. 19, 2015

(30) Foreign Application Priority Data

Jan. 4, 2012 (JP) ..... 2012-000150
Jan. 12, 2012 (JP) ..... 2012-003871

(51) Int. Cl.
*H04M 1/22* (2006.01)
*H04R 1/02* (2006.01)
(Continued)

(52) U.S. Cl.
CPC ..... *F21V 33/0056* (2013.01); *F21K 9/1355* (2013.01); *F21V 7/00* (2013.01);
(Continued)

(58) Field of Classification Search
CPC ..... F21V 33/0056; F21V 23/02; F21V 7/00; F21K 9/1355
USPC ..... 362/86
See application file for complete search history.

(56) References Cited

U.S. PATENT DOCUMENTS

2008/0225510 A1* 9/2008 Rocha ..... 362/86
2010/0141153 A1 6/2010 Recker et al.
(Continued)

FOREIGN PATENT DOCUMENTS

CN 102032543 A 4/2011
EP 2 400 780 A2 12/2011
(Continued)

OTHER PUBLICATIONS

U.S. Appl. No. 14/363,939, filed Jun. 9, 2014, Yotsumoto, et al.
(Continued)

*Primary Examiner* — Joseph L Williams
(74) *Attorney, Agent, or Firm* — Oblon, McClelland, Maier & Neustadt, L.L.P.

(57) ABSTRACT

[Object] To provide an electric light bulb type light source apparatus capable of suppressing the influence of heat from the light source unit to the speaker.

[Solving Means] An electric light bulb type light source apparatus includes a light source unit, a speaker, a driving module, a base and a support unit. The driving module is configured to drive the light source unit and the speaker. The base is used for supplying power to the driving module. The support unit integrally supports the speaker and the light source unit in such a manner that the speaker and the light source unit are separated from each other and the light source unit is disposed between the speaker and the base.

20 Claims, 8 Drawing Sheets

(51) Int. Cl.

| | |
|---|---|
| ***F21V 33/00*** | (2006.01) |
| ***F21K 99/00*** | (2016.01) |
| ***F21V 7/00*** | (2006.01) |
| ***F21V 23/02*** | (2006.01) |
| ***F21V 23/04*** | (2006.01) |
| *F21V 3/02* | (2006.01) |
| *F21V 23/00* | (2015.01) |
| *F21Y 103/02* | (2006.01) |

(52) U.S. Cl.

CPC ..... *F21V 7/0058* (2013.01); *F21V 23/02* (2013.01); *F21V 23/0435* (2013.01); *H04R 1/028* (2013.01); *F21V 3/02* (2013.01); *F21V 23/006* (2013.01); *F21Y 2103/022* (2013.01)

(56) References Cited

U.S. PATENT DOCUMENTS

| | | | |
|---|---|---|---|
| 2011/0074266 | A1 | 3/2011 | Sun |
| 2013/0175923 | A1 | 7/2013 | Yotsumoto et al. |
| 2013/0181607 | A1 | 7/2013 | Yotsumoto et al. |
| 2015/0028740 | A1 | 1/2015 | Yotsumoto et al. |

FOREIGN PATENT DOCUMENTS

| | | | |
|---|---|---|---|
| JP | 05-063191 | U | 8/1993 |
| JP | 2007-073438 | A | 3/2007 |
| JP | 2009-141924 | A | 6/2009 |
| JP | 2010-15754 | A | 1/2010 |
| JP | 2011-077015 | A | 4/2011 |
| JP | 2011-204637 | A | 10/2011 |
| WO | WO 2008/101253 | A1 | 8/2008 |
| WO | WO 2011/049435 | A1 | 4/2011 |

OTHER PUBLICATIONS

Office Action issued on Feb. 9, 2015 in co-pending related U.S. Appl. No. 13/717,962.

Extended European Search Report issued Jul. 30, 2015 in Patent Application No. 12864624.7.

Combined Chinese Office Action and Search Report issued Aug. 25, 2015 in Patent Application No. 201280064913.9 (with English language translation).

* cited by examiner (A)

(B)

ELECTRIC LIGHT BULB TYPE LIGHT SOURCE APPARATUS

TECHNICAL FIELD

The present disclosure relates to an electric light bulb type light source apparatus.

BACKGROUND ART

Patent document 1 discloses a stand type lighting apparatus having a function as a speaker. The lighting apparatus has a plurality of LED (light emitting diode) elements disposed on a lateral side of a cylinder. By a vibration of a vibrator coupled to a magnetostrictive actuator provided in the cylinder, a shade connected via an electric wire to this vibrator can vibrate to generate a sound (see, for example, paragraph 0020 in the specification and FIG. 1 of Patent Document 1).

A lighting apparatus described in Patent document 2 has a speaker. The speaker is disposed in the center of a case-type heat radiation element. In the heat radiation element, a light emitting diode module provided with a plurality of light emitting diode chips is disposed around the speaker (see, for example, paragraphs 0015 and 0017 in the specification and FIG. 1 of Patent Document 2).

Patent Document 1: Japanese Patent Application Laid-open No. 2009-141924

Patent Document 2: Japanese Patent Application Laid-open No. 2011-77015

Problem to be Solved by the Invention

Since the magnetostrictive actuator and the vibrator, which make up a part of the speaker of the lighting apparatus of Patent Document 1, are arranged inside the light emitting part that is formed in a cylindrical shape, the magnetostrictive actuator and the vibrator may easily be affected by the heat from the light emitting part. This may lead to deterioration of the function of the speaker.

On the other hand, the lighting apparatus of Patent Document 2 has the light emitting diode module and the speaker arranged in the same plane, near an open end of the heat radiation element. That is to say, since the speaker and the light emitting diode module are adjacent to each other, this case may also have a problem that the speaker may easily be affected by the heat from the light emitting diode module.

Besides, there is also a demand for good sound quality of the speaker installed in the lighting apparatus.

In view of the above-mentioned circumstances, the first object of the present disclosure is to provide an electric light bulb type light source apparatus capable of suppressing the influence of heat from the light source unit to the speaker.

The second object of the present disclosure is to provide an electric light bulb type light source apparatus capable of improving the sound quality of a speaker while suppressing the influence of heat from the light source unit to the speaker.

Means for Solving the Problem

In order to achieve the first object described above, an electric light bulb type light source apparatus according to the present disclosure includes a light source unit, a speaker, a driving module, a base and a support unit.

The driving module is configured to drive the light source unit and the speaker.

The base is used for supplying power to the driving module.

The support unit integrally supports the speaker and the light source unit in such a manner that the speaker and the light source unit are separated from each other and the light source unit is disposed between the speaker and the base.

With the support unit supporting the speaker and the light source unit in such a manner that these are separated from each other and the light source unit is disposed between the speaker and the base, it is possible to prevent the effect of heat from the light source to the speaker.

The light source unit may be disposed around an axis passing through the speaker along a vibration direction of a diaphragm included in the speaker. This may make it possible to increase a light distribution angle of the light source unit.

The light source unit may be provided in a ring-shaped form. This allows the light source unit to emit light by a uniform light quantity around the above-mentioned axis in the center.

The support unit may have a holding member adapted to hold at least the speaker, the holding member being disposed surrounded by the light source unit. While the speaker can be held by the holding member, the light source unit can be disposed around the holding member in the center. Therefore, it is possible to reduce the disposition space of the holding member and the light source unit in the electric light bulb type light source apparatus, that is, it is possible to increase the disposition density of these members, which can achieve the downsizing of the electric light bulb type light source apparatus while ensuring a desired light distribution angle.

The light source unit may include a mounting substrate which has a light source element mounted thereon, which mounting substrate may have a through hole or a cutout through which the holding member passes. This makes it possible to increase the disposition density of the light source unit including the mounting substrate and the holding member, which can achieve the downsizing of the electric light bulb type light source apparatus.

The holding member may have a reflection portion configured to reflect light emitted from the light source unit. This makes it possible to increase the light distribution angle of light emitted from the light source unit and effectively use light of the light source unit, which can increase the intensity of illumination.

The reflection portion may have a function of diffusely reflecting the light.

A part of the speaker may be made of a translucent material. Thus, light emitted from the light source unit passes through a part of the speaker, with the result that it is possible to increase light distribution characteristics leaning to the center of the electric light bulb type light source apparatus.

The light source unit may have an LED (light emitting diode) or an EL (electro luminescence) element as the light source element.

In order to achieve the second object described above, an electric light bulb type light source apparatus according to the present disclosure includes a light source unit, a speaker, a base, a support unit and a casing.

The base is used for supplying power to the light source unit and the speaker.

The support unit includes a holding member having an internal space and one or more openings communicating to the internal space, which holding member is adapted to hold at least the speaker. The support unit integrally supports the speaker and the light source unit in such a manner that the speaker and the light source unit are separated from each other and the light source unit is disposed between the speaker and the base.

The casing has a translucent cover and is configured to house the light source unit and the support unit.

This electric light bulb type light source apparatus, with the support unit supporting the speaker and the light source unit in such a manner that they are separated from each other and the light source unit is disposed between the speaker and the base, makes it possible to prevent the effect of heat from the light source to the speaker. In addition, the holding member, which holds the speaker, has its internal space and one or more openings communicating to this internal space. This makes it possible to use the internal space of the holding member as an enclosure for a speaker, which can improve the sound quality of the speaker. Consequently, it makes it possible to improve the sound quality of a speaker while suppressing the influence of heat from the light source unit to the speaker.

The light source unit may be disposed around the holding member. This allows it to reduce the disposition space of the holding member and the light source unit in the electric light bulb type light source apparatus, that is, it is possible to increase the disposition density of these members, which can achieve the downsizing of the electric light bulb type light source apparatus.

The electric light bulb type light source apparatus may further include a power source substrate and a drive substrate.

The power source substrate is housed inside the casing. The power source substrate has a void area, and is configured to supply power to the light source unit and the speaker.

The drive substrate has at least one of a drive circuit for the light source unit and a drive circuit for the speaker, being mounted thereon. The drive substrate is housed inside the casing. The drive substrate is disposed in the internal space of the holding member, in such a manner that the drive substrate has a part thereof being disposed in the void area.

In this electric light bulb type light source apparatus, the power source substrate has a void area. The power source substrate and the drive circuit are housed in the casing in such a manner that the drive substrate has a part thereof being disposed in the void area of the power source substrate. Further, the drive substrate is disposed in the internal space of the holding member. This makes it possible to efficiently dispose components in the small containing space of the casing and achieve the downsizing of the electric light bulb type light source apparatus.

The support unit may support the light source unit and the power source substrate in such a manner that the support unit has a part thereof being disposed in the void area of the power source substrate, and the power source substrate is disposed between the light source unit and the base. For the support unit supporting the light source unit and the power source substrate, by disposing a part of the support unit in the void area of the power source substrate, it makes it possible to achieve the space saving of the disposition of the support unit in addition to that of the substrates.

The electric light bulb type light source apparatus may further include a reflection member.

The reflection member may be disposed between the light source unit and the opening, which reflection member may be configured to reflect light emitted from the light source unit.

This may prevent the light of the light source unit from entering the opening of the holding member. Thus, it may make it possible to effectively use the light of the light source unit.

The reflection member may have a function of diffusely reflecting the light.

Each of the one or more openings may have a slit shape. This may prevent the light from entering the opening.

The void area may be a through hole or a cutout being formed in the power source substrate.

The drive substrate may be disposed to cross the power source substrate via the through hole or the cutout of the power source substrate.

Effects of the Invention

As described above, according to the present disclosure, it is possible to suppress the influence of heat from the light source unit to the speaker.

As described above, according to another point of the present disclosure, it is possible to improve the sound quality of a speaker while suppressing the influence of heat from the light source unit to the speaker.

MODE(S) FOR CARRYING OUT THE INVENTION

Embodiment 1 of Light Source Apparatus

Hereinafter, some embodiments of the present disclosure will be described with reference to the drawings.

[Overall Structure of Electric Light Bulb Type Light Source Apparatus]

Figure 1:
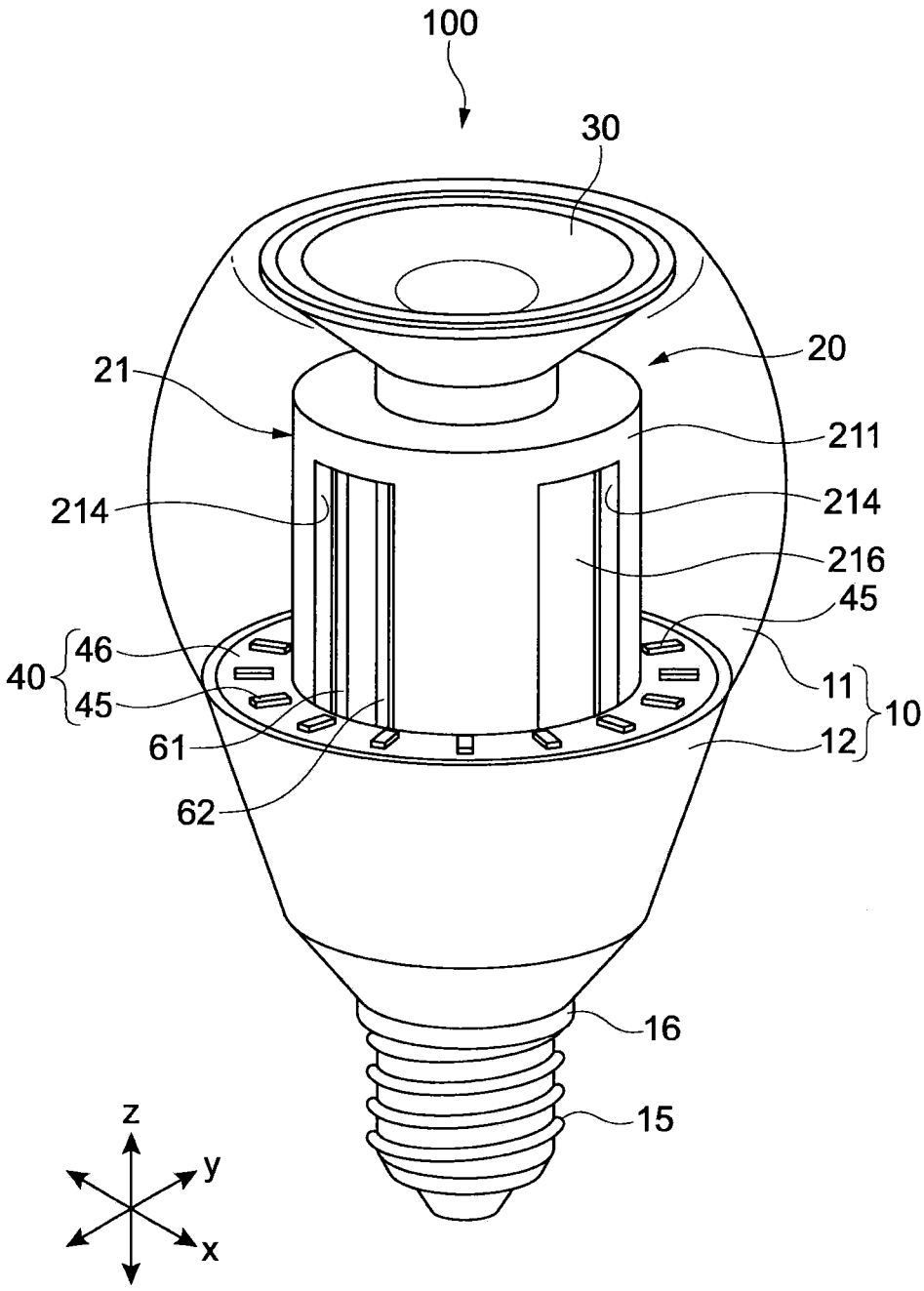
FIG. 1 A perspective view showing an electric light bulb type light source apparatus according to an embodiment (embodiment 1) of the present disclosure.
Figure 2:
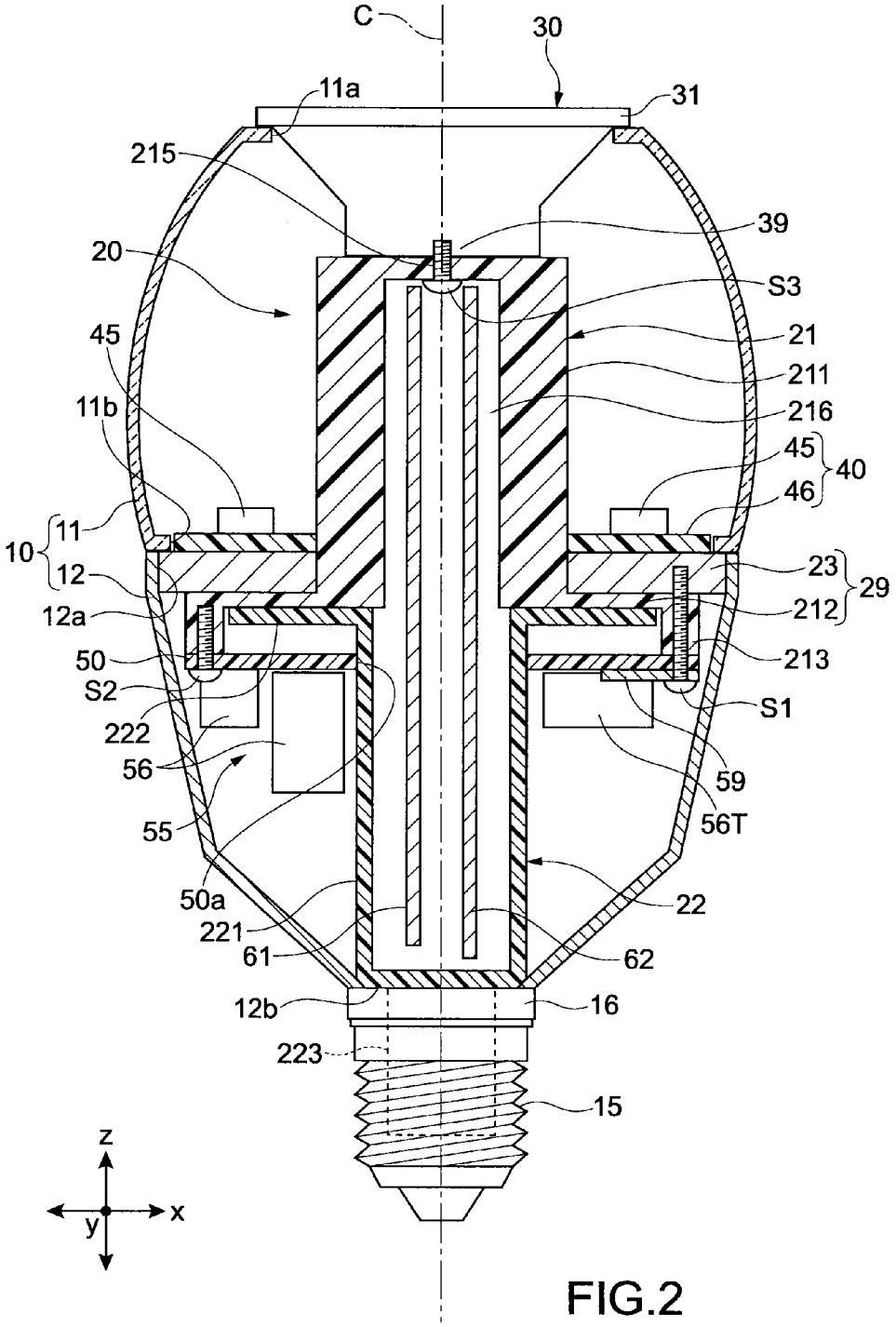
FIG. 2 A schematic cross-sectional view showing the electric light bulb type light source apparatus shown in FIG. 1.

FIG. 1 is a perspective view showing an electric light bulb type light source apparatus 100 according to an embodiment of the present disclosure. FIG. 2 is a schematic cross-sectional view showing the electric light bulb type light source apparatus 100 shown in FIG. 1. In the following description, the electric light bulb type light source apparatus is simply referred to as a light source apparatus.

The light source apparatus 100 is provided with a casing 10, a light source unit 40 disposed in the casing 10, a speaker 30 provided on one end portion of the casing 10, and a base 15 connected to the other end portion (opposite side to the position of the speaker 30) of the casing 10 with an electrically insulating ring 16 disposed therebetween.

For convenience of explanation, in the following, it is assumed that a direction along a z axis in FIGS. 1 and 2 is a back-and-forth direction of the light source apparatus 100, and specifically, the speaker 30 side corresponds to a front side, and the base 15 side corresponds to a rear side.

The casing 10 has, for example, a base casing 12 and a translucent cover 11 which is attached to the base casing 12. As shown in FIG. 2, the translucent cover 11 has a first opening portion 11*a* formed on an end portion on the front side and a second opening portion 11*b* formed on the opposite side thereto along the z axis direction. The speaker 30 is attached to the translucent cover 11 so as to block the first opening portion 11*a*. On the side of the second opening portion 11*b* of the translucent cover 11, the base casing 12 is provided. The translucent cover 11 may be made of, for example, glass, acrylic, polycarbonate, or the like.

The light source apparatus 100 is provided with a support unit 20 that supports the speaker 30. The support unit 20 integrally supports the light source unit 40, the speaker 30, and the base 15 so that the speaker 30 and the light source unit 40 is separated from each other, and the light source unit 40 is disposed between the speaker 30 and the base 15. As shown in FIG. 2, typically, the support unit 20 has a heat sink 23, a holding member 21 that is fixed to the heat sink 23 and holds the speaker 30, and a substrate containing box 22 that is disposed so as to be opposed to the holding member 21.

The heat sink 23 of the support unit 20 functions as a chassis of the light source apparatus 100. The heat sink 23 is disposed around a center axis C (see FIG. 2), which is an axis that passes through the center of the speaker 30 along a vibration direction (z axis direction) of a diaphragm 35 (see FIG. 3) included in the speaker 30. The area indicated by the term "around the axis" includes the entire circumference of the axis and a part thereof. Typically, the heat sink 23 has a plate shape and is formed around the entire circumference of the center axis C, that is, formed into a ring shape.

The light source unit 40 is also disposed around the center axis C like the heat sink 23 and is typically formed into a ring shape and disposed on the heat sink 23. For example, the light source unit 40 has a ring-shaped mounting substrate 46 and a plurality of LED (light emitting diode) elements 45 arranged in a ring form on the mounting substrate 46. For one LED element 45, an element that generates white light is used, but an element that generates light of a single color other than white or a plurality of colors may be used.

The heat sink 23 is mainly made of aluminum, for example. However, the heat sink 23 may be made of other metal materials such as copper, as long as the material has high thermal conductivity. Otherwise, the heat sink 23 may be made of ceramics or a heat-dissipating resin.

The base 15 is formed so as to be mountable on a socket of a general incandescent light bulb. The base 15 is a member that supplies power to a circuit substrate on which various circuits are mounted, the light source unit 40, and the speaker 30 via a power source circuit 55 which will be described later.

The length of the light source apparatus 100 in the z axis direction is 100 to 120 mm, typically about 110 mm. The diameter of the light source apparatus 100 viewed in the z axis direction is 50 to 70 mm, typically about 60 mm.

[Specific Structure of Speaker]

Figure 3:
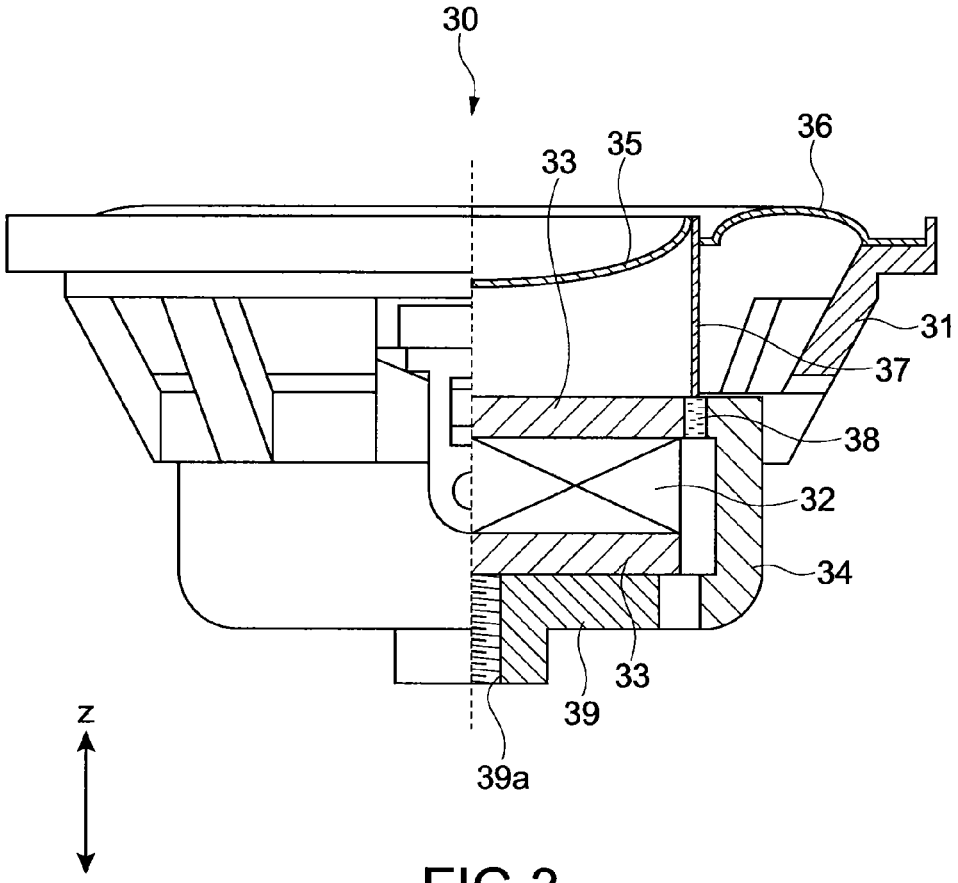
FIG. 3 A cross-sectional view showing a speaker according to the embodiment.

FIG. 3 is a cross-sectional view showing the speaker 30 according to the embodiment. The speaker 30 is a dynamic type damperless speaker. The speaker 30 is provided with a frame 31, a permanent magnet 32, a plate 33, a yoke 34, the diaphragm 35, an edge 36, a coil bobbin 37, a magnetic fluid 38, and an attachment bottom portion 39.

Instead of a damper in related art, the magnetic fluid 38 is provided in a magnetic gap between the yoke 34 and the plate 33 on the upper side thereof. Further, in the magnetic gap, a voice coil (not shown) is provided. On the attachment bottom portion 39, a threaded hole 39*a* is formed. As will be described later, through the threaded hole 39*a*, the speaker 30 is attached to the holding member 21 of the support unit 20 with a screw S3 (see FIG. 2).

As will be described later, in this embodiment, because the speaker 30 and the light source unit 40 are disposed separately from each other, the speaker 30 is unlikely to be affected by heat of the light source unit 40. Therefore, as the permanent magnet 32 used for the speaker 30, a permanent magnet having a relatively low heat resistance, that is, relatively low demagnetization temperature can be used. For example, a permanent magnet having the demagnetization temperature of 60° C. to 100° C. (inclusive) can be used. As the permanent magnet having the demagnetization temperature of 100° C. or less, neodymium can be used, for example.

The magnetic force of a neodymium magnet is higher than that of a ferrite core magnet or the like, and the demagnetization temperature of the neodymium is about 80° C., which is lower than that of ferrite. In the case where the ferrite core magnet is applied to the speaker 30 of the light source apparatus 100 according to this embodiment, to obtain a magnetic force equivalent to the magnetic force of the neodymium magnet, the size of the ferrite core magnet has to be increased, which is not suitable for the downsizing of the light source apparatus 100. It is also thought that a heat generation quantity of the light source unit 40 is reduced so as not to demagnetize the permanent magnet, but this means that input power to the light source apparatus 100 is suppressed, which reduces a light flux quantity.

In view of the above, in this embodiment, neodymium having a lower heat resistance and a larger magnetic force than ferrite is used, and the speaker 30 and the light source unit 40 is disposed so as to be separated from each other, with the result that the above problem is overcome.

For example, at least a part of the frame 31 of the speaker 30 and at least a part of the edge 36 may be made of a translucent material. As the translucent material, a known material such as an acrylic-based resin material, a polyvinyl-based resin material, and a polyimide-based resin material is used. Thus, light emitted from the light source unit 40 passes through a part of the speaker 30, with the result that it is possible to increase light distribution characteristics leaning to the center of the light source apparatus 100.

[Specific Structure of Support Unit]

Figure 4:
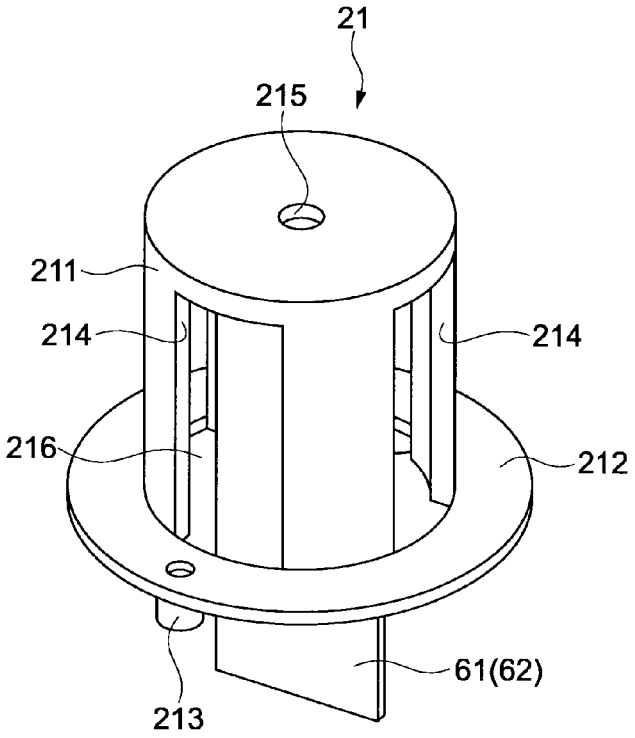
FIG. 4 A perspective view showing a holding member of a support unit.

FIG. 4 is a perspective view showing the holding member 21 of the support unit 20. The holding member 21 has a tubular portion 211 to which the speaker 30 is attached and a flange portion 212 provided on an end portion on the rear side of the tubular portion 211. The holding portion 21 is disposed in the casing 10 so that the tubular portion 211 passes through the center hole of the heat sink 23 and the light source unit 40, and a longitudinal direction of the tubular portion 211 is extended along the z axis direction.

On an end surface on the front side of the tubular portion 211, a threaded hole 215 is formed. In the threaded hole 215 and the threaded hole 39*a* which is formed in the speaker 30, the screw S3 (see FIG. 2) is screwed. With this structure, the speaker 30 is held by the holding member 21. The way of attaching the speaker 30 to the holding member 21 is not limited to the screwing, and bonding with an adhesive or engagement with an uneven member may be used.

As shown in FIG. 2, the holding member 21 is attached to the heat sink 23 with a screw S1. Specifically, on the flange portion 212 of the holding member 21, an attachment portion 213 for screwing is formed so as to be projected toward the rear side. The heat sink 23 is placed on the flange portion 212, and the holding member 21 is attached to the heat sink 23 through the attachment portion 213 from the back surface side (rear side) of the heat sink 23.

With the structure of the holding member 21 and the heat sink 23 as described above, because the light source unit 40 is disposed separately from the speaker 30 to the rear side thereof as described above, it is possible to suppress the influence of heat from the light source unit 40 to the speaker 30. As a result, it is possible to desirably maintain the function of the speaker 30. For example, in the case where the influence of heat to the speaker 30 is large, there is a problem in that the demagnetization of the permanent magnet 32 provided to the speaker 30 may occur, but by the light source apparatus 100 according to this embodiment, it is possible to overcome such a problem.

Further, the speaker 30 is disposed on the side from which light of the light source unit 40 is emitted, that is, on a position where the emitted light may be blocked. The light source unit 40 is provided in a ring-shaped form, thereby increasing a light distribution angle. Furthermore, the light source unit 40 can emit light with the light distribution as a uniform light quantity with respect to the center axis C.

In this embodiment, the holding member 21 that holds the speaker 30 is disposed so as to be surrounded by the light source unit 40. Therefore, it is possible to reduce the disposition space of the holding member 21 and the light source unit 40 in the electric light bulb type light source apparatus 100, that is, it is possible to increase the disposition density of these members, which can achieve the downsizing of the light source apparatus 100 while ensuring a desired light distribution angle.

To the tubular portion 211 of the holding member 21, a reflection portion that reflects light emitted from the light source unit 40 may be provided. The reflection portion is a part formed of a mirror surface or a material having color with a high light reflectance, for example. The color with the high reflectance refers to white, milky while, or color close to those, for example. Of course, the holding member 21 itself may be formed of a white or milky while resin material. As the resin material, ABS (acrylonitrile butadiene styrene), PBT (polybutylene terephthalate), or the like is used, but it is also possible to use other materials therefor. The reflection portion may also be provided as a separate member from the tubular portion 211 of the holding member 21.

In addition, in the case where the reflection portion is formed of a white or milky white material, for example, the reflection portion can diffusely reflect (scatter) light. Alternatively, when the reflection portion has a reflection surface that is subjected to a blast process, the reflection surface also can diffusely reflect light.

As described above, by providing the reflection portion, it is possible to increase the light distribution angle of light emitted from the light source unit 40 and effectively use light of the light source unit 40, which can increase the intensity of illumination.

Figure 5:
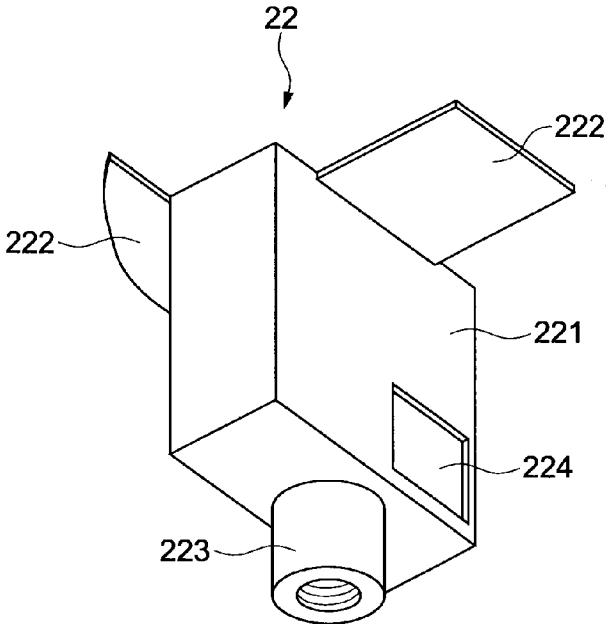
FIG. 5 A perspective view showing a substrate containing box of the support unit viewed from below.

FIG. 5 is a perspective view showing the substrate containing box 22 of the support unit 20 viewed from below. The substrate containing box 22 has a main body 221, a plurality of contact plates 222, and a projection portion 223. The contact plates 222 are projected in a direction perpendicular to the z axis from the main body 221, and the projection portion 223 is projected in the z axis direction from the main body 221. In FIG. 5, the plurality of contact plates 222 having different shapes are provided, but only one contact plate 222 may be provided.

Further, in the main body 221, a connection hole portion 224 to which a connector for conduction (not shown) is connected is formed. A plurality of connection hole portions 224 may be formed.

As shown in FIG. 2, the main body 221 is uprightly provided along the z axis direction, and the holding member 21 and the substrate containing box 22 are disposed in the casing 10 so as to be opposed to each other so that the contact plates 222 are in contact with the flange portion 212 of the holding member 21. In an area formed in the holding member 21 and the substrate containing box 22 disposed as described above, that is, in an area in the tubular portion 211 and the main body 221, some circuit substrates are disposed. A plurality of such circuit substrates, for example, two circuit substrates may be provided (drive substrate 61 and control substrate 62). As will be described later, the drive substrate 61 is provided as a common substrate on which an LED drive circuit 614 and an audio amplifier (AMP) 613 (see FIG. 7) to be described later are mounted. At least the drive substrate 61 functions as a driving module.

The projection portion 223 is disposed in the base 15 so as to be inserted in an opening end portion 12*b* on the rear side of the base casing 12, as shown in FIG. 2. The projection portion 223 is formed in a tubular form and disposed so that a lead (not shown) that connects a terminal of a top portion of the base 15 and a power source substrate 50 to be described later with each other passes through the inside of the projection portion 223.

Like the holding member 21, the substrate containing box 22 is formed of a nonconductive material, for example, an ABS resin material mainly. In this way, a desirable material as an electrically insulating material and a fire-retardant material is used for the holding member 21 and the substrate containing box 22.

In the tubular portion 211 of the holding member 21, a plurality of openings 214 are formed. As a result, in the casing 10, via the openings 214, an external area of the tubular portion 211 of the holding member 21 is communicated with an area in the tubular portion 211 and the substrate containing box 22. With this structure, in the casing 10, it is possible to use not only the external area of the tubular portion 211 but also the area in the tubular portion 211 and the substrate containing box 22 as an enclosure of the speaker 30. As a result, the volume of the enclosure becomes larger, which improves the sound quality of the speaker 30. It should be noted that it is also possible to have only one opening 214 formed in the tubular portion 211.

The base casing 12 is formed of a material having relatively high thermal conductivity, for example, mainly aluminum. As a material of the base casing 12, any other metal material such as copper may be used as long as the material has high thermal conductivity. Alternatively, a material of the base casing 12 may be a heat-dissipating resin or ceramics. The heat sink 23 and the base casing 12 are thermally connected with each other. As shown in FIG. 2, for example, an opening end portion 12*a* formed on the base casing 12 and a side surface of the heat sink 23 are in contact with each other directly or through a heat conductive sheet or the like, thereby causing heat conduction between the members. As a result, heat generated from the light source unit 40 is efficiently radiated to the outside via the heat sink 23 and the base casing 12.

It should be noted that the heat sink 23 and the base casing 12 may be formed of different main materials.

With reference to FIG. 2, the translucent cover 11 is disposed with respect to the base casing 12 so that an opening surface of the opening end portion 12*a* of the base casing 12 and an opening surface of the second opening portion 11*b* of the translucent cover 11 face each other. The support unit 20 supports the speaker 30 so that the translucent cover 11 is pressed against the heat sink 23 with the speaker 30, and the speaker 30 and the support unit 20 sandwich the translucent cover 11.

The heat sink 23 mainly forms a base portion 29 of the support unit 20. The base portion 29 of the support unit 20 includes the flange portion 212 of the holding member 21. Further, the base portion 29 of the support unit 20 may include the base casing 12.

As described above, the speaker 30 supported by the support unit 20 sandwiches the translucent cover 11 with the heat sink 23 and supports the translucent cover 11 with the translucent cover 11 pressed against the heat sink 23. Thus, it is not necessary to directly fix the translucent cover 11 to the heat sink 23 and the speaker 30. Therefore, even if the translucent cover 11 having a thermal expansion coefficient different from the thermal expansion coefficients of the heat sink 23 and (the frame 31 of) the speaker 30 is thermally expanded due to a temperature change of the light source unit 40, deformation due to the thermal expansion at the opening portions 11*a* and 11*b* that face the speaker 30 and the heat sink 23, respectively, is tolerated, and it is possible to let a stress of the thermal expansion get away. Thus, it is possible to suppress such an accident that a mechanical stress is generated in the translucent cover 11, and the translucent cover 11 deteriorates.

[Structures of Various Circuit Substrates]

As shown in FIG. 2, in the base casing 12, the power source substrate 50 on which the power source circuit 55 is mounted is contained. The power source substrate 50 is attached to the holding member 21 with a screw S2. Further, with the screw S1 that connects the holding member 21 and the heat sink 23 with each other, the power source substrate 50 is also attached to the heat sink 23.

Here, in general, in the viewpoint of suitability of an LED light bulb to a lighting apparatus, the shape of the LED light bulb is desired to be close to the shape of an incandescent light bulb, and the LED light bulb is desired to be downsized as much as possible. If a product size of the LED light bulb is significantly large, the quality of the product is degraded. In the case where the power source substrate and a drive circuit substrate of the LED are disposed on the same plane or disposed along a parallel plane, the product size is increased, and an outer circumferential size of a casing in the vicinity of a base is also increased. In the viewpoint of the suitability to a lighting apparatus, it is ideal to achieve an LED light bulb having the outer circumferential size of the casing in the vicinity of the base which is close to that of the incandescent light bulb. Therefore, in such a viewpoint, a product in which the power supply substrate and another circuit substrate are disposed on the same plane as described above leads to the degradation of the quality of the product. In view of this, in the present disclosure, the circuit substrates are disposed as follows.

Figure 6:
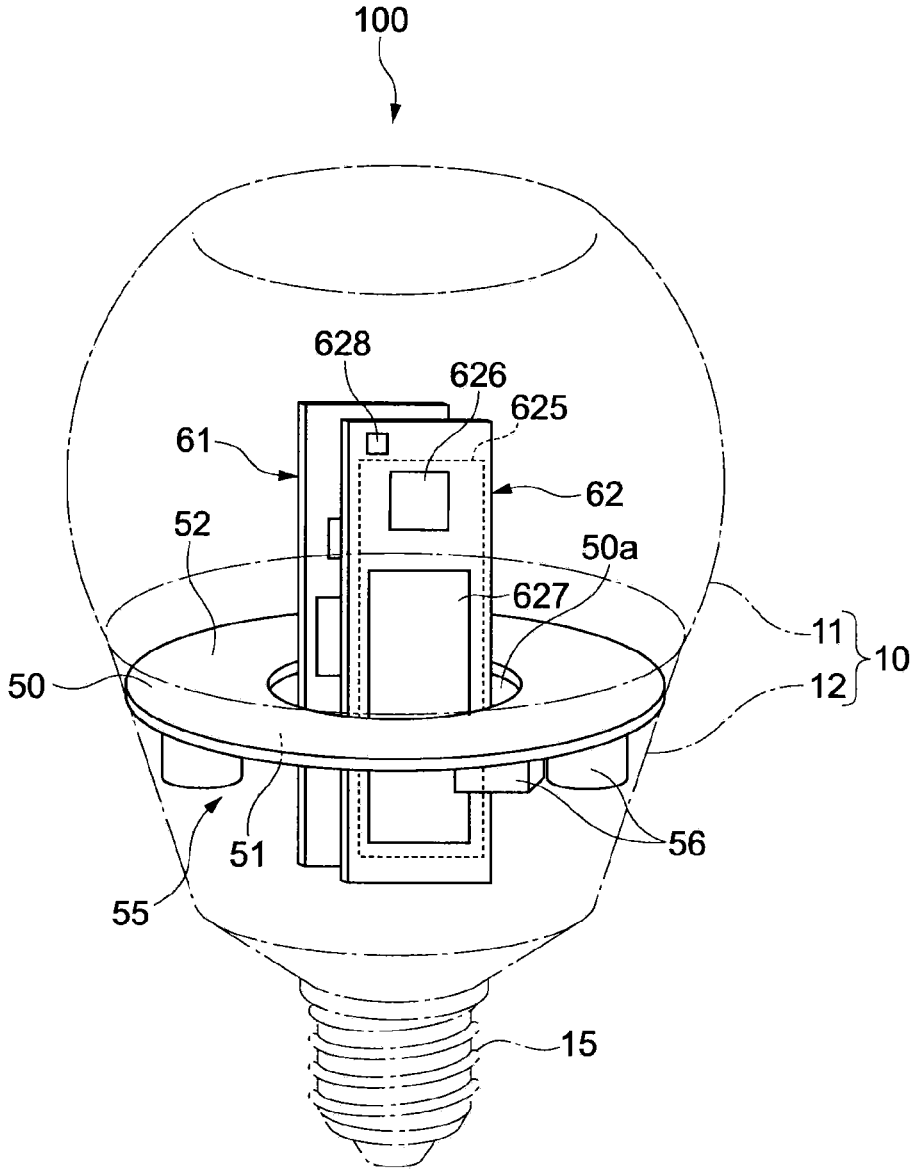
FIG. 6 A diagram showing a disposition relationship between a power source substrate and other substrates (drive substrate and control substrate).

FIG. 6 is a diagram showing a disposition relationship between the power source substrate 50 and the other substrates (drive substrate 61 and control substrate 62 as described above). The power source substrate 50 has a void area 50*a*, and the drive substrate 61 and the control substrate 62 are partly disposed in the void area 50*a*.

Typically, the void area 50*a* is formed of a through hole, that is, the power source substrate 50 is formed into a ring shape. Specifically, as shown in FIG. 2, in the void area 50*a*, the main body 221 of the substrate containing box 22 is inserted. As a result, the drive substrate 61 and the control substrate 62 disposed in the holding member 21 and the substrate containing box 22 are disposed so as to perpendicularly cross the power source substrate 50 through the through hole of the power source substrate 50.

As described above, the drive substrate 61 and the control substrate 62 are disposed so as to be inserted in the through hole of the power source substrate 50, so it is possible to efficiently dispose components in the small containing space of the casing 10 and achieve the downsizing of the light source apparatus 100.

Specifically, an envelope shape of the entire substrates disposed as described above approaches the shape obtained by disposing two schematic triangular shapes oppositely to each other along the z axis direction. The shape approaches an outline of the casing 10 in which the base casing 12 and the translucent cover 11 are fitted when the light source apparatus 100 is viewed from the side. That is, by disposing the substrates 50, 61, and 62 as described above, it is possible to increase the density of the components in the casing 10, which can downsize the light source apparatus 100.

Further, it is possible to densely dispose the substrates 50, 61, and 62 in the casing 10, so the volume of the speaker 30 as the enclosure can be sufficiently ensured, which can improve the sound quality of the speaker 30.

As shown in FIG. 6, on the control substrate 62, a receiving unit (or light receiving unit) 628, an antenna 626, and a network control circuit 627 are mounted.

The receiving unit 628 receives an infrared signal transmitted from a remote controller (not shown) which can be used by a user. The position and posture of the control substrate 62 are set so that the receiving unit 628 is disposed on a position where the infrared signal can be received, that is, disposed in an area (area on the front side of the light source unit 40) in the translucent cover 11 in the casing 10. For example, the receiving unit 628 is mounted on an end portion on the front side of the control substrate 62. The remote controller (not shown) is an apparatus that generates signals for turning-on and -off, dimming, and toning of the light source unit 40, and the like.

Typically, the antenna 626 is an antenna for near field communication such as Bluetooth. Further, the network control circuit 627 is compliant with the communication standard. The position and posture of the drive substrate 61 are set in such a manner that the antenna 626 would be disposed on a position in the casing 10 where a radio signal can be received, that is, disposed in an area within the translucent cover 11 (area on the front side of the light source unit 40). For example, an AV (audio video) apparatus serving as an apparatus to be operated by the user transmits a radio signal, and the antenna 626 receives the radio signal. For example, the signal transmitted from the AV apparatus is a signal of a sound volume of sound from the speaker 30, reproduction and stop thereof, and the like. As the AV apparatus, a portable apparatus may be used.

It should be noted that the antenna 626 and the network control circuit 627 may be compliant with the communication standard for constructing WiFi (wireless fidelity), ZigBee, a wireless LAN (local area network), or the like, in addition to Bluetooth.

The power source substrate 50 has a first surface 51 that is opposed to the base 15 side and a second surface 52 that is opposed to the light source unit 40 side. Further, the power source circuit 55 mounted on the power source substrate 50 has a transformer 56T (see FIG. 2) including a primary side coil and a secondary side coil and a primary side electronic component 56 electrically connected to the primary side coil. The transformer 56T and the primary side electronic component 56 are mounted on the first surface 51 of the power source substrate 50.

As described above, the transformer 56T and the primary side electronic component 56 each having a relatively large size are disposed on the base 15 side of the power source substrate 50, thereby making it possible to dispose a component different from the power source circuit 55, for example, a part of the light source unit 40 and the support unit 20 in a space on the front side of the second surface 52. As a result, it is possible to effectively use a small space in the casing 10 (or base casing 12).

[Electrical Structure of Light Source Apparatus]

Figure 7:
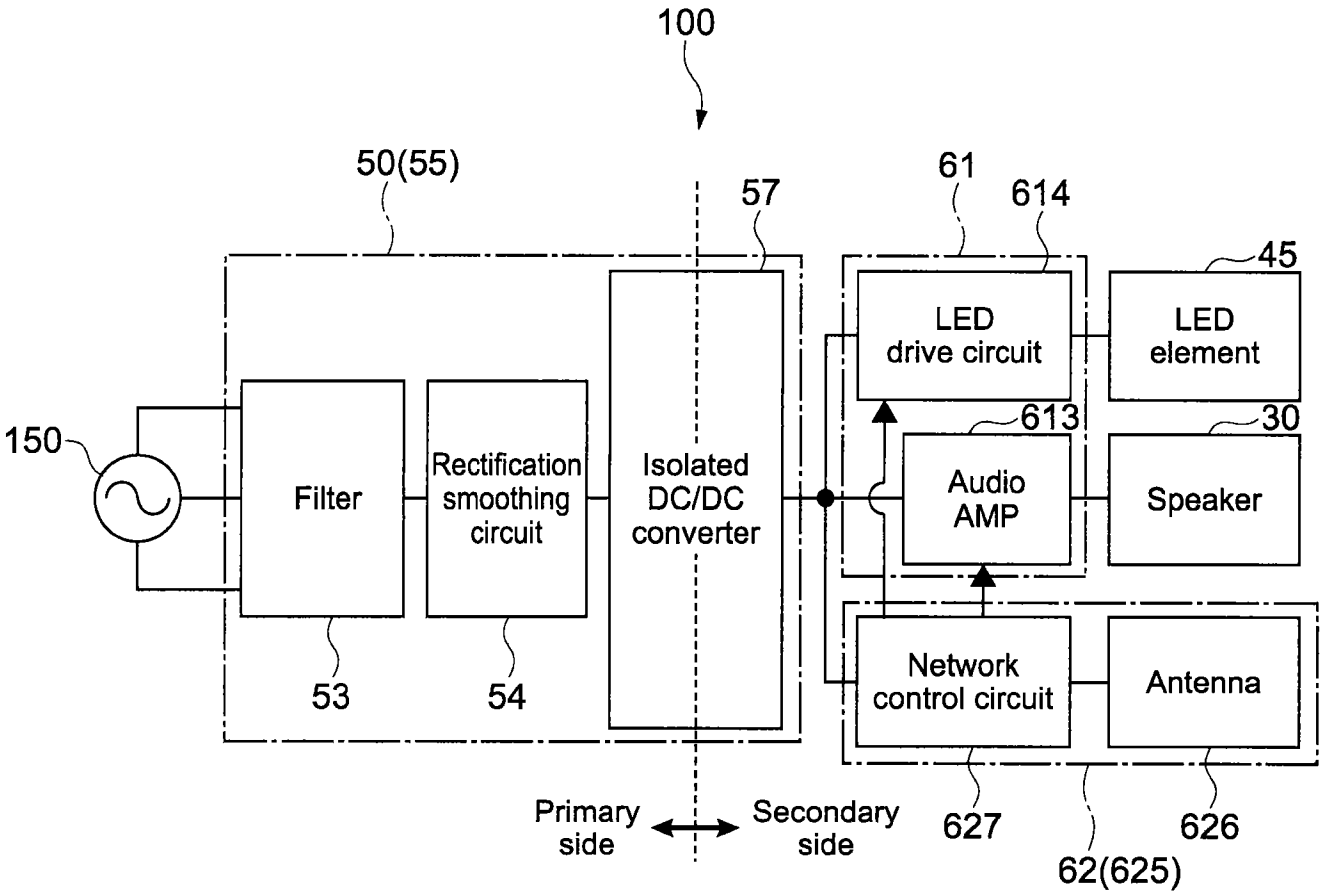
FIG. 7 A block diagram showing an electrical structure of the light source apparatus.

FIG. 7 is a block diagram showing an electrical structure of the light source apparatus 100.

The light source apparatus 100 is provided with a filter 53, a rectification smoothing circuit 54, an isolated DC/DC converter 57, the LED drive circuit 614, the audio AMP 613, the network control circuit 627, and the antenna 626. A commercial power source 150 supplies power to the power source circuit 50 via the base 15 of the light source apparatus 100.

The filter 53, the rectification smoothing circuit 54, and the isolated DC/DC converter 57 are the power source circuits 55 and are mounted on the power source substrate 50 as described above. The isolated DC/DC converter 57 includes the transformer 56T. For the power source circuit 55, the isolated DC/DC converter 57 is used to electrically insulate the primary side circuit and the secondary side circuit from each other.

The LED drive circuit 614 and the audio AMP 613 are mounted on the drive substrate 61 as described above. The LED drive circuit 614 performs control for turning-on and -off, dimming, and toning of the light source unit 40, and the like. The audio AMP 613 is the drive circuit of the speaker 30 and controls a sound volume of sound from the speaker 30, reproduction and stop thereof, and the like.

As described above, the network control circuit 627 and the antenna 626 are a part of a control circuit 625 and are mounted on the control substrate 62. On the basis of a signal received via the receiving unit 628 and the antenna 626, the network control circuit 627 outputs information relating to the content of the signal received to the LED drive circuit 614 and the audio AMP 613.

[Structure of Ground Connection of Electric Circuit]

As shown in FIG. 2, on the first surface 51 of the power source substrate 50, a secondary side ground connection pattern 59 is formed. The ground connection pattern 59 is conducted with the heat sink 23 and the base casing 12 via the screw S1. That is, the heat sink 23 and the base casing 12 serve as electrical grounds for the power source circuit 55.

As described above, in this embodiment, an insulated power source circuit is used, and the secondary side circuit thereof is grounded. Therefore, it is possible to obtain an appropriate EMS (electromagnetic susceptibility) without generating an EMI (electromagnetic interference) or the like, with the result that the condition of an EMC (electromagnetic compatibility) can be satisfied. In other words, according to the present technology, it is possible to suppress the leakage of high frequency noises from the drive substrate 61 or the like and suppress the leakage of radiation noises from the speaker 30. Further, it is of course possible to prevent exogenous noises from entering the base casing 12.

Further, in this embodiment, members that form a ground potential are the heat sink 23 and the base casing 12 that function as the heat radiation members. That is, the heat sink 23 and the base casing 12 are each equipped with the functions of the ground potential formation and the heat radiation, and therefore it is unnecessary to provide an additional ground member, which contributes to the downsizing of the light source apparatus 100.

By carrying out the EMC countermeasure as described above with respect to the light source apparatus 100, it is possible to apply the light source apparatus 100 to a so-called smart house.

Other Embodiments of Light Source Apparatus

The present disclosure is not limited to the above embodiment, and various other embodiments can be implemented.

In the above embodiment 1, the light source unit 40 on which the LED element 45 that has the point light emission function is mounted is used as an example. The light source unit is not limited to this and may be, for example, an organic or inorganic EL (electro luminescence) element, that is, a light source unit having a surface light emission function, or a fluorescent lamp such as a CCFL (cold cathode fluorescent lighting (lamp)) having a three dimensional light emission function.

Further, the light source unit 40 has the ring shape but may have a polygonal shape having three or more sides or a linear shape (one or more linearly formed shapes). In a similar sense, the power source substrate 50 may also have one of other shapes.

In the above embodiment, the damperless speaker is used as an example of the speaker 30, but a general type speaker 30 with no magnetic fluid 38 may be used.

The support unit 20 according to the above embodiment 1 is made up mainly of the holding member 21 and the like. However, for example, it is also possible to allow the speaker 30 to be supported solely by a translucent cover, which translucent cover can serve as a part of the support unit.

The void area 50*a* of the power source substrate 50 may be formed of a cutout instead of the through hole. Alternatively, the void area 50*a* may be formed with both the through hole and the cutout. In this case, the power source substrate 50 is formed into a C-letter shape. Alternatively, the power source substrate 50 may be formed into a half-ring shape.

In the above embodiment 1, the receiving unit 628 for the infrared signal is mounted on the control substrate 62 but may be mounted on the drive substrate 61. Alternatively, it is not always necessary to provide the receiving unit 628 for the infrared signal from the remote controller.

In the following descriptions, the same components and functions as those included in the description of the light source apparatus 100 according to the above-described embodiment 1 will be simplified or omitted, and different points will be mainly described.

Embodiment 2 of Light Source Apparatus

As shown in FIG. 2, the base 15 side of the drive substrate 61 and the base 15 side of the control substrate 62 may be, for example, covered by the substrate containing box 22 which is nonconductive, so that it can reliably maintain insulation in the base 15 side, especially insulation between the base 15 side of each substrate and the primary side circuit of the power source circuit. In this sense, it is also possible to use a nonconductive sheet instead of this substrate containing box 22.

In the tubular portion 211 of the holding member 21, a plurality of openings 214 are formed. The plurality of openings 214 communicates to an internal space 216 in the tubular portion 211. As a result, in the casing 10, via the openings 214, an external area of the tubular portion 211 of the holding member 21 is communicated with the internal space 216 in the tubular portion 211 and an area in the substrate containing box 22. With this structure, in the casing 10, it is possible to use not only the external area of the tubular portion 211 but also the internal space 216 in the tubular portion 211 and the area in the substrate containing box 22 as an enclosure of the speaker 30. As a result, the volume of the enclosure becomes larger, which improves the sound quality of the speaker 30. It should be noted that it is also possible to have only one opening 214 formed in the tubular portion 211. That is, one or more openings 214 may be formed.

Embodiment 3 of Light Source Apparatus

Figure 8:
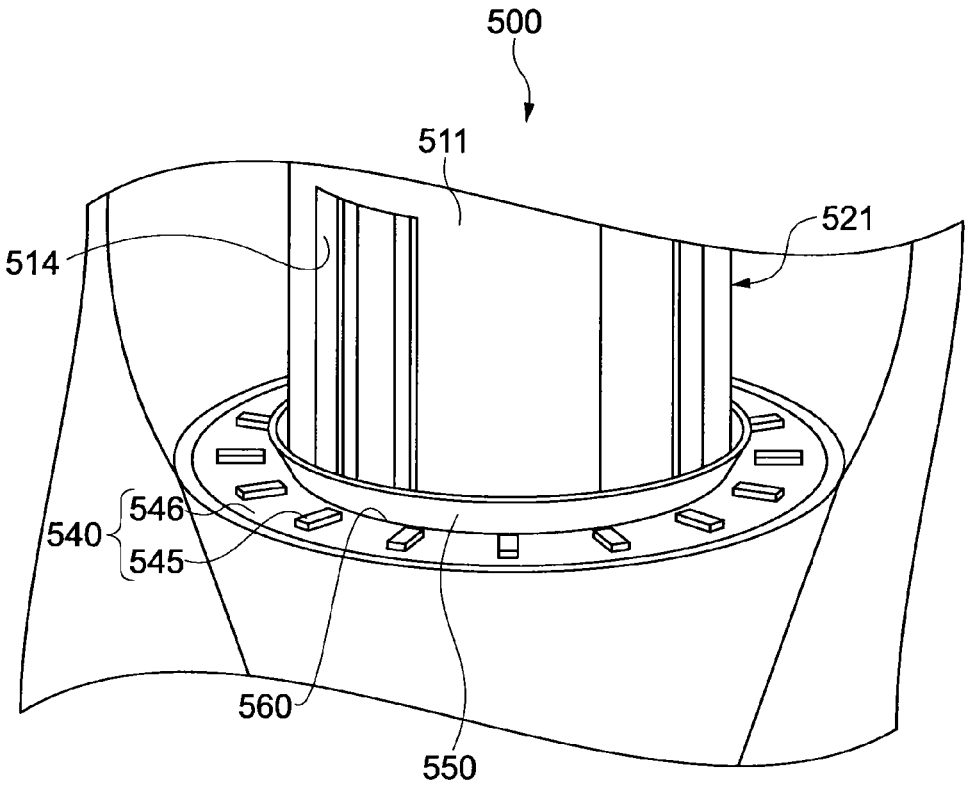
FIG. 8 A perspective view showing a part of an electric light bulb type light source apparatus according to another embodiment (embodiment 3) of the present disclosure.

For example, FIG. 8 is a perspective view showing a part of an electric light bulb type light source apparatus 500 as an embodiment 3. The electric light bulb type light source apparatus 500 has a reflector 550 which is disposed between a light source unit 540 and an opening 514 and is configured as a reflection member to reflect the light emitted from the light source unit 540.

The reflector 550 is disposed on the rear side of a tubular portion 511 of a holding member 521 so as to surround the tubular portion 511. That is, the reflector 550 may be disposed along the light source unit 540 surrounding the tubular portion 511. The reflector 550 may be provided inclined in the x axis direction from an edge of a through hole 560 provided in the center of a mounting substrate 546 of the light source unit 540. The reflector 550 may be provided inclined from the edge of the through hole 560, in the direction toward the position where LED elements 545 of the light source unit 540 are disposed. In this way, the reflector 550 would be disposed between the light source unit 540 and the openings 514.

The reflector 550 may be made of a material similar to the reflection portion of the holding member 21 described above. That is, the reflector 550 may be formed of a mirror surface, a material having color with a high light reflectance, a material which diffusely reflects light, or the like. For example, as the reflector 550, a resin material such as ABS and PBT may be used.

As described above, the reflector 550 as the reflection member is provided, thereby making it possible to prevent the light of the light source element 540 from entering the openings 514 of the holding member 521. Thus, it may make it possible to effectively use the light of the light source unit 340. Furthermore, by providing the reflector 550, it enables enhancement of utilization efficiency in illuminating the outside with the light of the light source element 540, which can increase the intensity of illumination.

The shape of the reflector 550, the position where the reflector 550 is attached, and the like, are not limited to those shown in FIG. 8. For example, around the tubular portion 511, a reflector 550 which extends in a direction parallel to the mounting substrate 546 may be disposed.

The reflector 550 may also be integrally formed with the holding member 521. Otherwise, the reflector 550 that is formed as a separate member may be assembled as a part of the holding member 521. In this case, the reflector 550 may function as the above-mentioned reflection portion as well. Alternatively, the mounting substrate 546 and the reflector 550 may be integrally formed together.

Embodiment 4A of Light Source Apparatus

Figure 9:
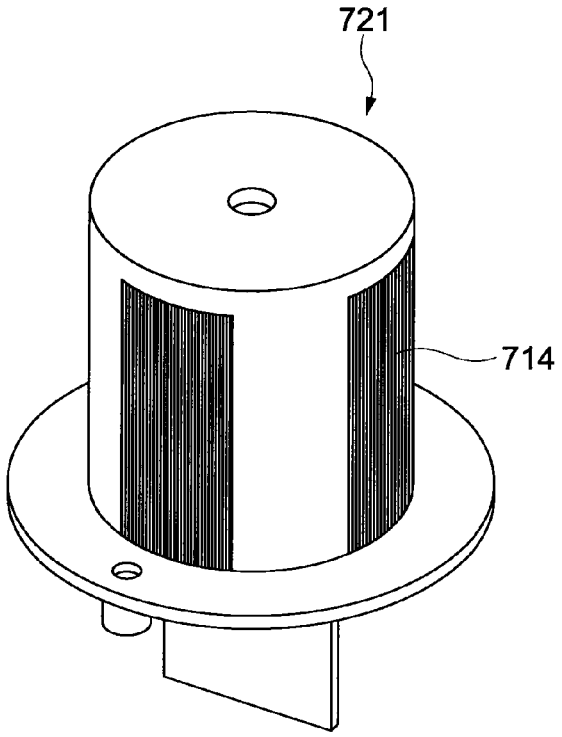
FIG. 9 A figure showing some variation examples (embodiments 4A and 4B) of a plurality of openings formed in a tubular portion.
Figure 9:
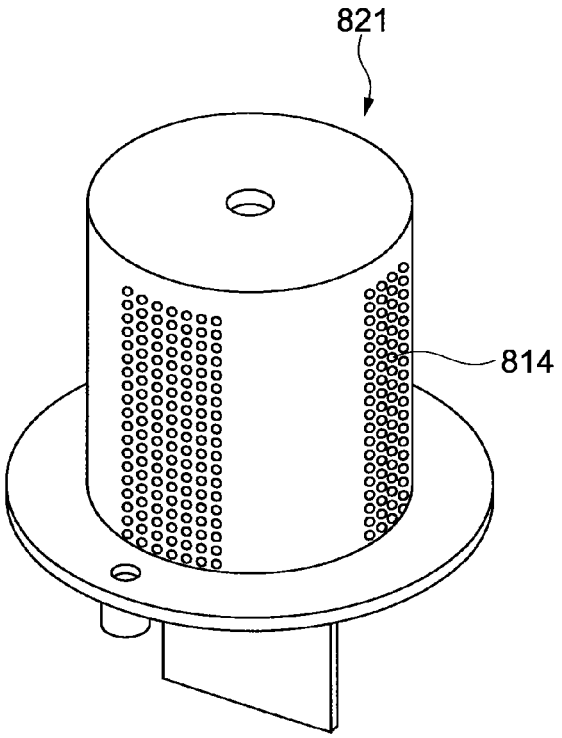

FIG. 9 is a figure showing some variation examples of a plurality of openings formed in a tubular portion. As shown in "A" of FIG. 9, one or more openings 714 each having a slit shape may be formed in a holding member 721. By forming such openings 714 having a slit shape, it would be possible to prevent the light of the light source element from entering the openings 714 of the holding member 721. It should be noted that the length of the slits, interval of the slits, and the like, may be set as appropriate.

Embodiment 4B of Light Source Apparatus

As shown in "B" of FIG. 9, as one or more openings of a holding member 821, a plurality of through holes 814 having approximately circular shapes may be formed in the holding member 821. The size of each through hole 814, the number of through holes 814, and the like, may be set as appropriate. For example, by reducing the size of each through hole 814, it would be possible to prevent the light of the light source element from entering the openings (through holes 814) of the holding member 821. It should be noted that the shapes of the through holes 814 are not limited to approximately circular shapes, but may otherwise be rectangular shapes, polygonal shapes, or the like.

The shape, the number, the size, the position, and the like of the one or more openings formed in the holding portion are not limited to those shown in FIG. 4, FIG. 9 or the like, but may be set as appropriate. The opening(s) which would not easily allow the light to enter from the light source unit, but which make it possible to use the internal space of the holding member as an enclosure for the speaker, may be formed as appropriate. For example, a plurality of openings may be formed in the holding member, to have a shape like a window shade. That is, a plurality of openings may be formed so as to penetrate the tubular portion, which would make a structure in which the internal space is almost not visible from the outside of the tubular portion. This may prevent the light of the light source unit from entering the opening.

More Embodiments of Light Source Apparatus

In the above embodiments 1 and 2, on one drive substrate 61, the drive circuits of the light source unit 40 and the speaker 30 are mounted, but those may be mounted on separate circuit substrates. In addition, for example, one out of the drive circuit of the light source unit 40 and that of the speaker 30 may be mounted on the power source substrate 50, while another may be mounted on the drive circuit 61. That is, it is also possible to employ a configuration in which at least one of a drive circuit for the light source unit 40 and a drive circuit for the speaker 30 is mounted on the drive substrate 61. Further, in the above embodiments 1 and 2, the drive substrate 61 and the control substrate 62 are provided as different substrates but may be provided as a common substrate.

Out of the characteristic parts of the embodiments described above, at least two characteristic parts can be combined.

The present disclosure can take the following configurations.

(1) An electric light bulb type light source apparatus, including:

a light source unit;

a speaker;

a driving module configured to drive the light source unit and the speaker;

a base used for supplying power to the driving module; and a support unit integrally supporting the speaker and the light source unit in such a manner that the speaker and the light source unit are separated from each other and the light source unit is disposed between the speaker and the base.

(2) The electric light bulb type light source apparatus according to (1), in which the light source unit is disposed around an axis passing through the speaker along a vibration direction of a diaphragm included in the speaker.

(3) The electric light bulb type light source apparatus according to (2), in which the light source unit is provided in a ring-shaped form.

(4) The electric light bulb type light source apparatus according to (2) or (3), in which the support unit has a holding member adapted to hold at least the speaker, the holding member being disposed surrounded by the light source unit.

(5) The electric light bulb type light source apparatus according to (4), in which the light source unit includes a mounting substrate having a light source element mounted thereon, the mounting substrate having a through hole or a cutout through which the holding member passes.

(6) The electric light bulb type light source apparatus according to (4) or (5), in which the holding member has a reflection portion configured to reflect light emitted from the light source unit.

(7) The electric light bulb type light source apparatus according to (6), in which the reflection portion has a function of diffusely reflecting the light.

(8) The electric light bulb type light source apparatus according to any one of (1) to (7), in which a part of the speaker is made of a translucent material.

(9) The electric light bulb type light source apparatus according to any one of (1) to (9), in which the light source unit has an LED (light emitting diode) or an EL (electro luminescence) element as a light source element.

(10) An electric light bulb type light source apparatus, including:

a light source unit;

a speaker;

a base used for supplying power to the light source unit and the speaker;

a support unit including a holding member having an internal space and one or more openings communicating to the internal space, the holding member being adapted to hold at least the speaker, the support unit integrally supporting the speaker and the light source unit in such a manner that the speaker and the light source unit are separated from each other and the light source unit is disposed between the speaker and the base; and a casing having a translucent cover, the casing being configured to house the light source unit and the support unit.

(11) The electric light bulb type light source apparatus according to (10), in which the light source unit is disposed around the holding member.

(12) The electric light bulb type light source apparatus according to (10) or (11), in which the light source unit includes a mounting substrate having a light source element mounted thereon, the mounting substrate having a through hole or a cutout through which the holding member passes.

(13) The electric light bulb type light source apparatus according to any one of (10) to (12), further including:

a power source substrate housed inside the casing, the power source substrate having a void area, the power source being configured to supply power to the light source unit and the speaker; and a drive substrate having at least one of a drive circuit for the light source unit and a drive circuit for the speaker, being mounted thereon, the drive substrate being housed inside the casing, the drive substrate being disposed in the internal space of the holding member, in such a manner that the drive substrate has a part thereof being disposed in the void area.

(14) The electric light bulb type light source apparatus according to (13), in which the support unit supports the light source unit and the power source substrate in such a manner that the support unit has a part thereof being disposed in the void area of the power source substrate, and the power source substrate is disposed between the light source unit and the base.

(15) The electric light bulb type light source apparatus according to any one of (10) to (14), further including:

a reflection member disposed between the light source unit and the opening, the reflection member being configured to reflect light emitted from the light source unit.

(16) The electric light bulb type light source apparatus according to (15), in which the reflection member has a function of diffusely reflecting the light.

(17) The electric light bulb type light source apparatus according to any one of (10) to (16), in which the holding member has a reflection portion configured to reflect light emitted from the light source unit.

(18) The electric light bulb type light source apparatus according to (17), in which the reflection portion has a function of diffusely reflecting the light.

(19) The electric light bulb type light source apparatus according to any one of (10) to (18), in which each of the one or more openings has a slit shape.

(20) The electric light bulb type light source apparatus according to any one of (13) to (19), in which the void area is a through hole or a cutout being formed in the power source substrate.

(21) The electric light bulb type light source apparatus according to (20), in which the drive substrate is disposed to cross the power source substrate via the through hole or the cutout of the power source substrate.

(22) The electric light bulb type light source apparatus according to any one of (10) to (21), in which the light source unit has an LED (light emitting diode) or an EL (electro luminescence) element as a light source element.

DESCRIPTION OF REFERENCE SYMBOLS

10 casing
11 translucent cover
15 base
20 support unit
21, 521, 721, 821 holding member
30 speaker
40, 540 light source unit
45, 545 LED element (light source element)

46, 546 mounting substrate
50 power source substrate
50*a* void area
61 drive substrate
100, 500 electric light bulb type light source apparatus
214, 514, 714, 814 opening
216 internal space
550 reflector

The invention claimed is:

1. An electric light bulb type light source apparatus, comprising:
a light source unit;
a speaker;
driving circuitry configured to drive the light source unit and the speaker;
a base used for supplying power to the driving circuitry;
a support unit integrally supporting the speaker and the light source unit in such a manner that
the speaker and the light source unit are separated from each other and
the light source unit is disposed between the speaker and the base,
the support unit including
a holding member having an internal space and one or more openings communicating to the internal space, the holding member being adapted to hold at least the speaker; and
a casing having a translucent cover, the casing being configured to house the light source unit and the support unit.

2. The electric light bulb type light source apparatus according to claim 1, wherein
the light source unit is disposed around an axis passing through the speaker along a vibration direction of a diaphragm included in the speaker.

3. The electric light bulb type light source apparatus according to claim 2, wherein
the light source unit is provided in a ring-shaped form.

4. The electric light bulb type light source apparatus according to claim 2, wherein
the holding member is surrounded by the light source unit.

5. The electric light bulb type light source apparatus according to claim 4, wherein
the light source unit includes a mounting substrate having a light source element mounted thereon,
the mounting substrate having a through hole or a cutout through which the holding member passes.

6. The electric light bulb type light source apparatus according to claim 4, wherein
the holding member has a reflection portion configured to reflect light emitted from the light source unit.

7. The electric light bulb type light source apparatus according to claim 6, wherein
the reflection portion has a function of diffusely reflecting the light.

8. The electric light bulb type light source apparatus according to claim 1, wherein
a part of the speaker is made of a translucent material.

9. An electric light bulb type light source apparatus, comprising:
a light source unit;
a speaker;
a base used for supplying power to the light source unit and the speaker;
a support unit including
a holding member having an internal space and one or more openings communicating to the internal space, the holding member being adapted to hold at least the speaker,
the support unit integrally supporting the speaker and the light source unit in such a manner that
the speaker and the light source unit are separated from each other and
the light source unit is disposed between the speaker and the base; and
a casing having a translucent cover,
the casing being configured to house the light source unit and the support unit.

10. The electric light bulb type light source apparatus according to claim 9, wherein
the light source unit is disposed around the holding member.

11. The electric light bulb type light source apparatus according to claim 9, wherein
the light source unit includes a mounting substrate having a light source element mounted thereon,
the mounting substrate having a through hole or a cutout through which the holding member passes.

12. The electric light bulb type light source apparatus according to claim 9, further comprising:
a power source substrate housed inside the casing,
the power source substrate having a void area,
the power source being configured to supply power to the light source unit and the speaker; and
a drive substrate having at least one of a drive circuit for the light source unit and a drive circuit for the speaker, being mounted thereon,
the drive substrate being housed inside the casing,
the drive substrate being disposed in the internal space of the holding member, in such a manner that the drive substrate has a part thereof being disposed in the void area.

13. The electric light bulb type light source apparatus according to claim 12, wherein
the support unit supports the light source unit and the power source substrate in such a manner that
the support unit has a part thereof being disposed in the void area of the power source substrate, and
the power source substrate is disposed between the light source unit and the base.

14. The electric light bulb type light source apparatus according to claim 9, further comprising
a reflection member disposed between the light source unit and the opening,
the reflection member being configured to reflect light emitted from the light source unit.

15. The electric light bulb type light source apparatus according to claim 14, wherein
the reflection member has a function of diffusely reflecting the light.

16. The electric light bulb type light source apparatus according to claim 9, wherein
the holding member has a reflection portion configured to reflect light emitted from the light source unit.

17. The electric light bulb type light source apparatus according to claim 16, wherein
the reflection portion has a function of diffusely reflecting the light.

18. The electric light bulb type light source apparatus according to claim 9, wherein
each of the one or more openings has a slit shape.

19. The electric light bulb type light source apparatus according to claim 12, wherein the void area is a through hole or a cutout being formed in the power source substrate.

20. The electric light bulb type light source apparatus according to claim 19, wherein the drive substrate is disposed to cross the power source substrate via the through hole or the cutout of the power source substrate.

* * * * *